US005876142A

United States Patent [19]

Furukawa

[11] Patent Number: 5,876,142

[45] Date of Patent: Mar. 2, 1999

[54] BALL-POINT PEN

[75] Inventor: Kazuhiko Furukawa, Kouza-gun, Japan

[73] Assignee: Mitsubishi Pencil Kabushiki Kaisha, Tokyo, Japan

[21] Appl. No.: 864,170

[22] Filed: May 28, 1997

[30] Foreign Application Priority Data

Jun. 3, 1996 [JP] Japan ..... 8-160441

[51] Int. Cl.[6] ..... B43K 7/00

[52] U.S. Cl. ..... 401/209; 401/214; 401/216

[58] Field of Search ..... 401/209, 214, 401/215, 216, 141, 142

[56] References Cited

U.S. PATENT DOCUMENTS

| | | | |
|---|---|---|---|
| 3,216,399 | 11/1965 | Sams | 401/216 |
| 4,671,691 | 6/1987 | Case et al. | 401/142 |
| 4,722,124 | 2/1988 | Serikawa et al. | 401/216 |
| 5,421,664 | 6/1995 | Okamoto | 401/214 |
| 5,520,473 | 5/1996 | Durham | 401/216 |

*Primary Examiner*—David J. Walczak
*Attorney, Agent, or Firm*—Darby&Darby

[57] ABSTRACT

Press forming for preventing the ball from slipping out from the pen tip of a ball-point pen is carried out twice creating a sealing face brim having a width S and a curvature R substantially equal to that of the ball, inside the front part of the pen tip. Provided in the rear of the ball is a ball seat, and channels and longitudinal backlash which allow the ink to flow to the pen point are provided. Further, the front part of the point assembly may be formed with an open V-shaped tapered portion. A spring which constantly urges the ball forward may be provided inside the point assembly.

8 Claims, 4 Drawing Sheets

BALL-POINT PEN

BACKGROUND OF THE INVENTION (1) Field of the Invention

The present invention relates to a production of a point assembly for a ball-point pen in which a ball as a writing element is loosely held with some play and kept from slipping out with a properly sized gap which establishes a flow passage of ink, and further relates to improvement of a ball-point pen using a point assembly thereof.

(2) Description of the Prior Art

In conventional writing implements, ink evaporation occurring when the implement is not used for a long time is prevented by fitting a cap. Further, there are ball-point pens and small-tube type writing implements having a cap with a sealing element therein which is composed of elastic rubber, etc., and seals the pen point in order to prevent ink starvation or so-called forward leakage (ink drip from the pen point), which would occur due to drawing of air through the pen point when the pen is impacted by being dropped. However, in the case of a retractable or clicking type ball-point pen as well as in the case where the user has forgotten to fit the cap, in the case of a writing implement where the ink used is unavoidably volatile, and in other cases, ink starvation and air drawing tend to occur, and in the worst case the writing implement itself may accidentally become disabled. Countermeasures against such cases, include: inhibiting ink evaporation as much as possible by creating the point assembly of the ball-point pen of metal; increasing the viscosity of ink (up to 5,000 cp to 10,000 cp); increasing the content of non-volatile solvent; decreasing the out-flow of ink by narrowing the ink flow channel in the point assembly; and creating interior pressure within the barrel interior equal to or higher than the pressure of the surrounding air to cause the interior ink to flow out. In particular, these problems have not been resolved for so-called intermediate type ball-point pens which use ink of a medium viscosity and present intermediate properties between oily and aqueous ball-point pens. Although ball-point pens of this type have such imperfection, they have been put onto the market because of other merits.

In conventional ball-point pens, the problems of dry-up due to forward leakage, air drawing, evaporation or the like, are primarily solved by pressurizing the ink or the barrel interior, or by other appropriate mechanisms. Even if such a means is not provided, the point assembly is protected with a hermetic cap or by providing an elastic material such as rubber etc., in close contact with the tip of the point assembly. In the above cases, rather complicated mechanisms are needed, thus causing increased occurrence of accidents due to the imperfection of such mechanisms, or if the mechanism works well, it costs more increasing the price of the ball-point pen. For those in which the defects are offset by a cap only, it cannot provide an effective solution, for it has a further problem in that the performance cannot be maintained unless the user often puts the cap in place. For those in which the defects are solved by ink, this settlement is achieved by sacrificing the writing performances, such as drying performance of ink (i.e., ink not being likely to be dry after the drawing of lines) and writing sensation. To make matters worse, the ball seat in the point assembly will be worn out due to reduced smoothness of ink, so that the ink flow increases with use, and in the worst case, writing itself becomes impossible.

SUMMARY OF THE INVENTION

The present invention is primarily to provide an improved writing implement of generally called ball-point-pen-type wherein a ball to be the writing point is loosely held with play inside the point assembly of a popular type and is prevented from slipping out in such a manner that the ball is projected from the front end of the point assembly. It is another object of the invention to provide an inexpensive, high performance writing implement which is able to prevent problems of dry-up, air drawing, forward leakage, etc., associated with the sealing performance or the manufactured state of the sealing portion in the point assembly where sealing is formed of the writing ball and an interior sealing face having a curvature R substantially equal to that of the ball, and which is able to solve the problem in that ink adheres to the pen tip during writing and the collecting of ink blots thereon which stains the paper, without needing any special ink or mechanism.

The present invention has been devised in order to attain the above object, and the gist of the invention is as follows:

In accordance with the first aspect of the invention, a ball-point pen comprises: an ink reservoir tube which stores an ink therein; and a point assembly having a ball holder which holds a ball to be a writing point so that the ball is rotatably projected, and is formed with a plurality of, at least two, different angled press-formed portions at the front part thereof to prevent the ball from slipping out, and is characterized in that the inner bore of the ball holder has a sealing face brim having a width S and a curvature R substantially equal to that of the ball, the loosely held ball with play is movable in the axial direction with a longitudinal backlash F of greater than 3 $\mu$m (F>3 $\mu$m), the point assembly has a ball seat having a curvature R substantially equal to that of the ball at the rear of the ball with respect to the axial direction, and a plurality of channels are provided in the rear of the ball with respect to the axial direction to create ink flow passage during writing.

Next, in accordance with the second aspect of the invention, the ball-point pen having the above first feature is characterized in that the two different angled press-formed portions are composed of two parts of tapered angles A and B, and the tip assembly further has three tapered portions having tapered angles of C, D and E in the rear thereof, and that the tapered angles A, B, C, D, E, the width S of the inner sealing face brim and the press-fitted width L on the outer peripheral surface satisfy the following conditions:

$$A > B > C,\ D > C,\ D > E,$$

$$140^\circ \geqq A \geqq 55^\circ,\ E < 60^\circ, \text{ and}$$

$$L \geqq S \geqq L/10.$$

In accordance with the third and fourth aspects of the invention, the ball-point pen having the above first or second feature is characterized in that the point assembly has a spring therein which constantly urges the ball forward in the axial direction with a force smaller than 80g.

In accordance with the fifth through eight aspects of the invention, a ball-point pen having any of the above first through fourth features is characterized in that the ink reservoir tube directly holds an ink having a viscosity ranging from 10 cp to 4000 cp at 25° C., and a greasy follower at the rear end in contact with the ink.

The operation of the above means will be described hereinbelow. In typical ball-point pens, in order to prevent ink evaporation, air drawing into the point assembly and to prevent ink starvation, backward leakage and forward leakage when the pen is impacted by being dropped, a sealing material made of rubber is provided in the cap to seal the pen point, or a high viscosity ink or an ink which is unlikely to evaporate is used. However, these counter measures often give rise to new problems such as poor writing sensation, thinly drawn lines, poor drying performance of ink and the like. In the improved configuration of the invention, a sealing portion which has a curvature equal to that of the writing ball is formed inside the point assembly by press forming to establish a perfect seal which hermetically confines the point assembly from outside. Further, since press forming is carried out twice or more, the sealing portion can be formed perfectly without any fluctuation. Moreover, the width S of the sealing portion can be made smaller than the outside peripheral width L of the press-formed portion and equal to or greater than one-tenth of the width L, so that it is possible to stabilize the amount of ink flow.

In general, since writing implements are used for writing at an inclined angle of about 60° with respect to the paper surface, the two-step press forming process also functions to prevent friction with the paper surface.

Further, the provision of a spring which constantly urges the ball forwards, produces a reliable sealing performance as well as secures reliable sealing when the ball-point pen is oriented upward. In particular, the present invention functions most effectively when it is applied to an intermediate type ball-point pen using an ink having a relatively low viscosity. The press forming of the invention, specifically, the second and any following press forming which form a greater angle than that of the first press forming, function to prevent the so-called blotting problems, in that ink climbs up the pen tip during writing and the collecting ink drops after a certain period of time staining the paper, by inhibiting the climbing of ink.

DESCRIPTION OF THE PREFERRED EMBODIMENTS

Figure 1:
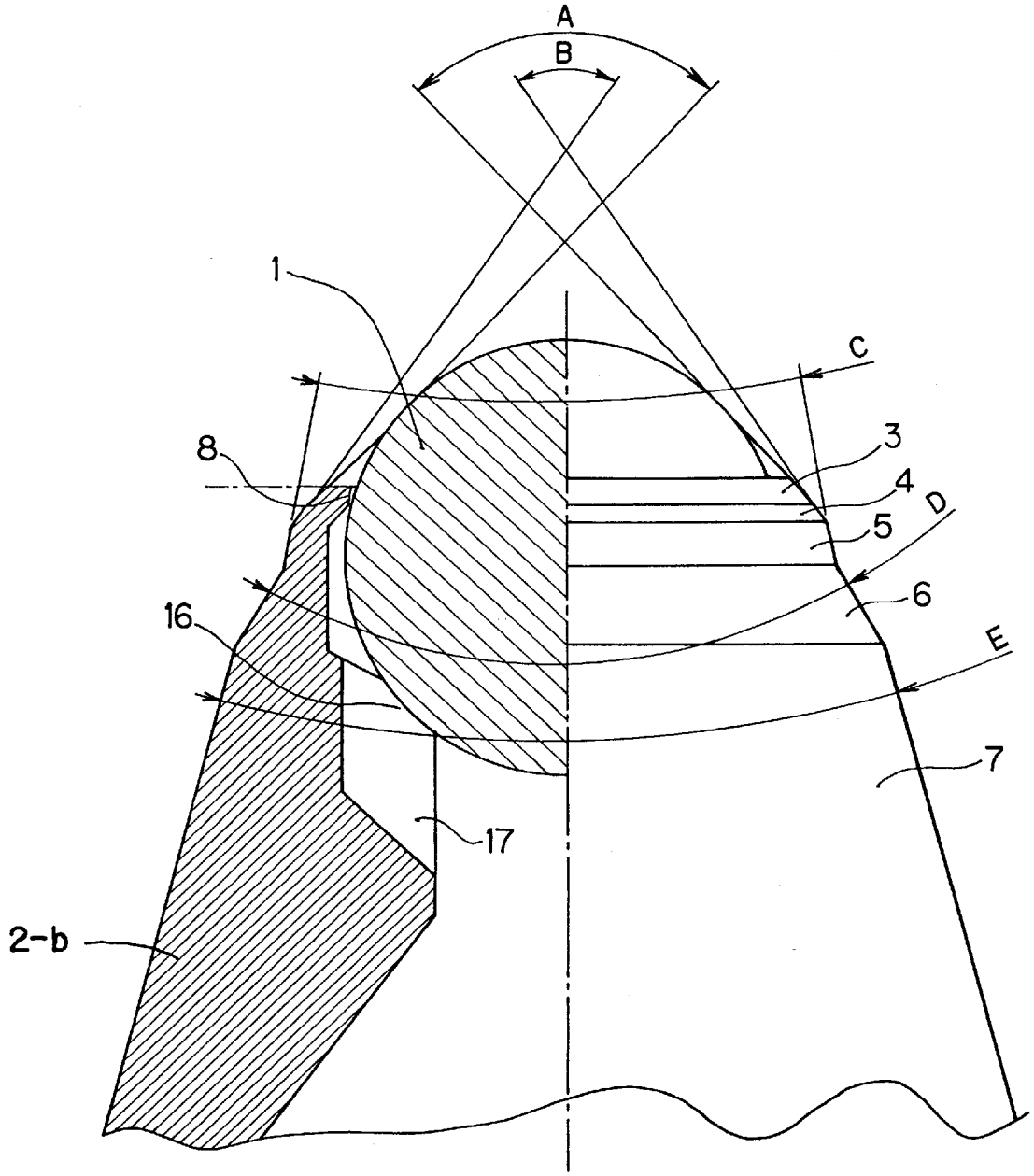
FIG. 1 is a vertical sectional view showing the front part of the structure of the point assembly of a writing implement in accordance with the embodiment of the invention.

FIGS. 1 to 4 show a direct liquid flow type ball-point pen using ink of a medium viscosity as an embodiment of the invention. The description will be made with reference to these drawings.

An ink reservoir tube 12 has ink 13, a greasy follower 14 and a solid follower rod 15 therein. Provided at the front end of a point assembly 2 is a writing ball 1 which is received by a ball seat 16 on its rear side and by press-formed portions 3 and 4 on its front side so as not to slip out. Ball 1 is loosely and rotatably held with a longitudinal backlash F of 3 $\mu$m or more (preferably 10 to 35 $\mu$m for the intermediate type ball-point pen) allowing back-and-forth movement.

Press-formed portion 3 is formed with an angle of 55° to 140°, and press-formed portion 4 is formed with a more acute angle than the former. In general, these press forming processes are carried out by plastic deformation of metal or the combination of plastic deformation and machining.

Interior face 8 of these press-formed portions has a curvature R which is substantially equal to that of ball 1, which abuts this sealing face 8 thus establishing a so-called sealed state, or securing confinement of the interior of the ball-point pen from the surrounding air.

Ball seat 16 disposed in the rear of ball 1 also has a curvature equal to R, this configuration prevents abrasion due to writing, making it possible to secure a stabilized flow rate.

Ink 13 can move from reservoir tube 12 toward the interior of the point assembly, that is, the flow passage of ink to ball 1 is secured by a channel 17, longitudinal backlash F and the lateral backlash G. It is more effective if a spring 9 which can slightly urge ball 1 forward is provided inside point assembly 2 by forming a press-formed portion 2-*a*. The provision of spring 9 may be with a straight portion in the front part thereof to directly urge ball 1, or may have other configurations, e.g., a spring with a separate piece (not shown) whose rear end is urged by the spring, or the rear end of the spring may be fixed so as not to come out, by a stepped portion (not shown) in the bore of a joint 10 instead of being press formed. Any of these configurations may be effective and show no difference.

In order to achieve an improved view of pen point 2-*b* for the user when writing, an acute-angled or gently tapered portion 7 is provided in the rear of press-formed portions 3 and 4. Further, tapered portions 5 and 6 which form a substantially open V-shape are provided to achieve a further improved view. In general, when press forming is carried out twice and the sealing face 8 is formed, ink becomes more difficult to flow than in a configuration which is press formed in a normal manner, since the ink passage becomes narrower and longer. However, since the above open V-shaped taper configuration 5, 6 and makes it possible to create extra wall thickness for press forming, this prevents deformation of the interior, specifically, the ink passage from becoming unnecessarily too long. In general, ink blots from the pen point 2-*b*, that is, surplus ink collects around the outer peripheral portion at the pen point 2-*b* and drops after a certain period of time. The two-step press-formed structure 3, 4 promotes ink, in a small amount, to often drip onto the 5, 6 and 7 paper surface, and further the open V-shaped tapered portion is too steep with respect to the pen axis to allow the ink to climb up the pen tip. Resultantly, blotting can be prevented.

Next, reasons for each of the restrictions in the invention will be described hereinbelow.

First, the restriction, longitudinal backlash F>3 $\mu$m, is that if the backlash is not more than 3 $\mu$m, the ink flow passage is confined so that ink 13 will not flow out. In particular, since a sealing face 8 is created in this invention, it is necessary to create a reliable flow passage, otherwise, the ball will confine the ink passage.

Second, the restriction, A>B>C, D>C and D>E, limits the outside shape of the point assembly of the invention, and this represents parameters of the open V shape and the two-step press forming process 3, 4. In this case, the two-step press forming process will contribute to stabilizing the inner sealing face 8 and reduction in uncomfortable or unsmooth sensation when writing, while the open V-shaped structure will contribute to stabilizing the sealing face 8 and prevention of blotting.

The restriction, 140°≧A≧55°, limits the angle of the second press forming 4 of the two-step press forming process. If this angle is greater than 140°, this closely perpendicular arrangement makes it difficult to achieve the press forming. If this angle is smaller than 55°, the ball 1 receives pressure on its side surface and cannot be in contact at its front part. In other words, a sealing face 8 is formed around the side of the ball 1 but cannot be formed around the front interior part, so that no gap for allowing the ink 13 to flow is created around the side, neither does the ball 1 make the correct confinement when the pen is oriented downwards.

Next, the restriction, E<60°, indicates that the angle of the writing portion needs to be smaller than 60°. If the tip portion is not thus pointed, the writing portion cannot be seen.

Subsequently, the restriction, L≧S≧L/10 will be explained. The case where L<S, the opposite of that in FIG. 2, means a state where rough edges or burrs are formed. If there is some burring, the writing performance will be degraded (the ball is unlikely to rotate smoothly). Further, the flow passage of ink 13 becomes narrower and longer within the sealing surface 8, making the flow of ink 13 difficult as it becomes longer. Where S<L/10, the sealing surface 8 is little formed, or will not be in close contact with the ball 1, resulting in ink leakage. In conventional configurations of sliver types, S was set smaller than L/10 (S<L/10), and in such a tip, the effect of the invention could unlikely be obtained.

The restriction of the spring load being equal to or below 80g is reasoned by the consideration of the writing load which ranges from 100g to 200g. Otherwise (if the spring load is greater than 80g), it becomes impossible to perform writing because the ball 1 always confines the channel 17.

The restriction of the ink viscosity range from 10 to 4000 cp, at 25° C. is set because the configuration of the invention is particularly effective for ball-point pens using a medium viscosity ink.

Figure 2:
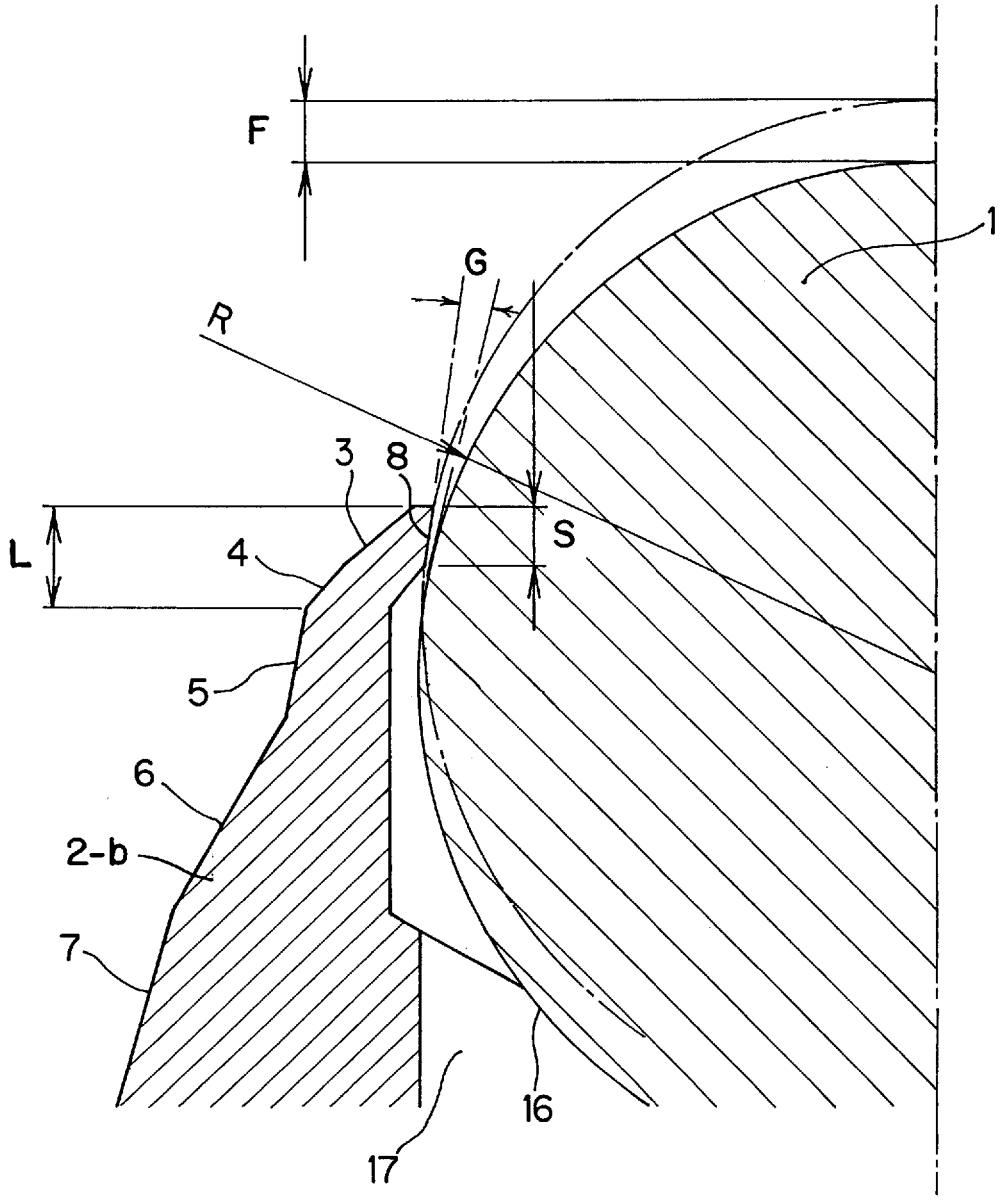
FIG. 2 is a vertical sectional view showing the structure of the front-most part of a writing implement in accordance with the embodiment of the invention.
Figure 3:
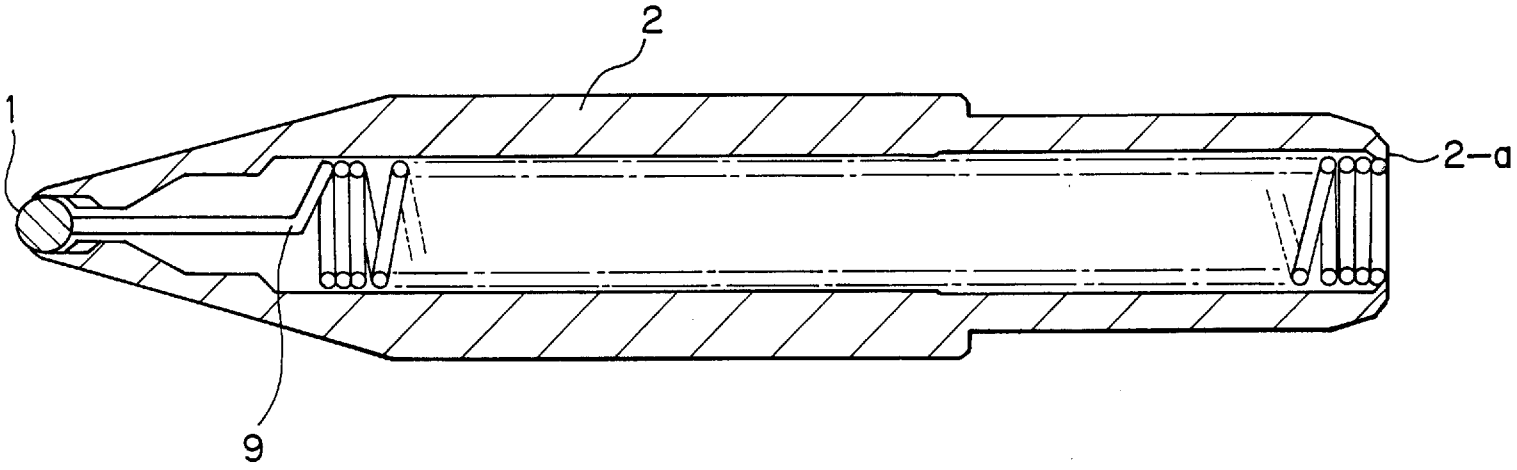
FIG. 3 is a vertical sectional view showing the structure of a point assembly in accordance with the embodiment of the invention.
Figure 4:
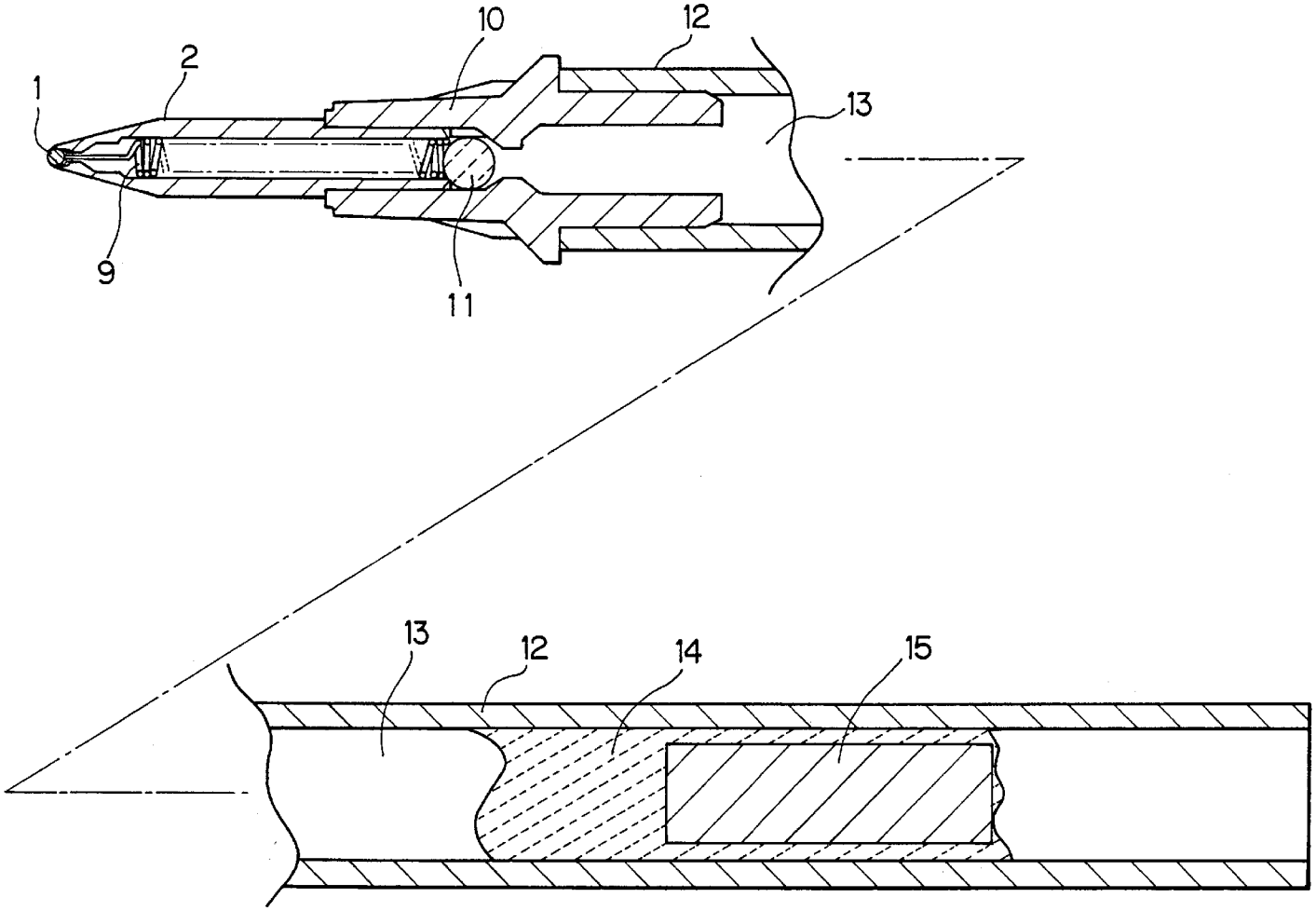
FIG. 4 is a vertical sectional view showing the overall structure of the invention.

Concerning the embodiments of the invention shown in FIGS. 1 and 2, examples (embodiments and comparative examples) in which the angles and dimensions were varied were tested and the results are shown in Table 1.

TABLE 1

| | Write feeling | Forward leakage | Abrasion | Ink flow | Ink stavation | Total judgmenet |
|---|---|---|---|---|---|---|
| Conventional Ex. 1 | Δ | x | Δ | ○ | x | A cap is strongly needed |
| Conventional Ex. 2 | Δ | Δ | Δ | ○ | Δ~x | A cap is needed |
| Embodiment 1 | ○ | Δ | ○ | ○ | ○~Δ | No practical drawbacks in use |
| Embodiment 2 | ○ | Δ | ○ | Δ | ○~Δ | Usable |
| Embodiment 3 | ○ | ○ | ○ | Δ | ○~Δ | No practical drawbacks in use |
| Embodiment 4 | ○ | ○ | ○ | ○ | ○ | No drawbacks |
| Comparative Ex. 1 | ○ | x | ○ | ○ | x~Δ | Unstable sealing |
| Comparative Ex. 2 | Δ | ○ | ○ | x | ○~Δ | Thin dawing lines |
| Comparative Ex. 3 | ○ | x | ○ | ○ | x~Δ | Insufficiency of the sealing face |
| Comparative Ex. 4 | ○ | ○ | ○ | x | ○~Δ | Thin dawing lines |
| Comparative Ex. 5 | ○ | Δ | x | ○ | ○~Δ | Abrasion was observed |

The evaluation was made with three levels: ○ for good, Δ for usable, and x for unusable.
Write feeling: evaluated by observing the friction with paper when the pen used by hand writing;
Forward leakage: evaluated by observing ink leakage when the pen is placed with its pen tip down;
Durability against abrasion: evaluated based on the JIS machine writing test to the end of ink;
Ink flow: evaluated based on the density of drawing lines in the JIS machine writing test; and
Ink starvation without cap: evaluated after the pen was left 7 days in a 25° C. 60% RH environment.
(Ink and barrel body): UM-100 black, a product ot MITSUBISHI PENCIL KABUSHIKI KAISHA, ink viscosity: 100 cp(25° C.)
(Conventional Ex. 1): A pen tip with only a press-formed portion 3 at an angle of 70°, used in UM-100, which is currently on the market
(Conventional Ex. 2): A case of comparative example 1 with a tip spring built therein
(Embodiment 1): Press-formed angle A = 140°, B = 60°, Sealed width S = ⅕L, F = 1) open V-shape angled portion: C = 20°, D = 60° and E = 30°
(Embodiment 2): A = 60°, B = 55° and, other conditions are the same in embodiment 1
(Embodiment 3): S = ⅘L and, other conditions are the same in embodiment 1
(Embodiment 4): A case of embodiment 1 with a 40 g tip spring built therein
(Comparative Ex. 1): A = 150° and, other conditions are the same in embodiment 1
(Comparative Ex. 2): A = 50° and, other conditions are the same in embodiment 1
(Comparative Ex. 3): S = 1/12L and, other conditions are the same in embodiment 1
(Comparative Ex. 4): S = L, and other conditions are the same in embodiment 1
(Comparative Ex. 5): no ball seat 16, and other cooditions are the same in embodiment 1

According to the invention, it is possible to solve the problems of an intermediate type ball-point pen using aqueous ink 13 of a retractable or clicking type which were unfeasible in the prior art, as well as the problems of ball-point pen having a cap with no sealing member therein, and the problems of an oily ball-point pen and of a direct liquid type ball-point pen.

In accordance with the invention, since it is possible to create reliable sealing at the pen tip, the pen does not need a cap or only needs a simple type of cap, without the necessity of high sealing ability therein. Therefore, it becomes possible to stably provide low-cost writing implements which are ready to be assembled as well as writing implements of a retractable type which were unfeasible in the prior art. Further, since reliable sealing can be created, it is possible to solve the problems concerning forward leakage, air drawing, ink starvation and abrasion durability even in a ball-point pen using an aqueous type ink which, dries easily, without using any special ink or any complicated mechanisms. In particular, it is possible to expect more improved effects, especially in a configuration in which a spring 9 is incorporated inside the point assembly 2 so as to press the writing ball 1 forward in close contact with the interior sealing face 8 of the invention. The present invention is effective in solving most of the defects in a so-called intermediate type ball-point pen using a medium viscosity ink, which had many drawbacks. Moreover, the present invention can show the same effects if it is applied to conventional oily type ball-point pens, sliver type ball-point pens, direct liquid type aqueous ball-point pens using an ink storage part of many comb-like slits and other types of ball-point pens. The present invention is more effective in providing a problem-free writing implement when it is combined with an anti-backward leakage mechanism such as a checking valve ball 11.

What is claimed is:

1. A ball-point pen comprising:

an ink reservoir tube adapted to store an ink: and a point assembly having a front end adapted to be a writing point, a rear end adapted to receive ink from the ink reservoir tube, and a longitudinal axis extending from the rear end to the front end, the point assembly having an inner bore with a rim at the front end and a forward facing ball seat positioned rearwardly from the front end, the inner bore supporting a writing ball between the rim and the ball seat such that the ball is rotatably projected from the front end, the ball has a surface having a curvature, the ball seat has a curvature corresponding to the surface curvature of the ball, and a plurality of channels in the ball seat permit ink flow from the rear end of the point assembly to the front end of the point assembly during writing; wherein:

the point assembly is formed with a first press-formed portion having an outwardly facing annular surface with a first angle of taper, the first press-formed portion positioned at the front end of the point assembly, and a second press-formed portion having an outwardly facing annular surface with a second angle of taper, the second press formed portion positioned rearwardly from the first press-formed portion, the first angle of taper differing from the second angle of taper, the first and second press-formed portions formed such that the rim is inwardly deformed to a dimension smaller than the diameter of the ball to retain the ball in the inner bore, and the first and second press-formed portions formed such that an inwardly directed sealing surface is formed at the rim of the inner bore, the sealing surface having a width S taken along the longitudinal axis, and having a curvature corresponding to the surface curvature of the ball; and wherein:

the ball is movable along the longitudinal axis for a distance F of greater than 3 $\mu$m between a first position in rotatable engagement with the ball seat and a second position in which the width S of the sealing surface is in sealing engagement with a corresponding portion of the surface of the ball, and wherein the first press-formed portion has an angle of taper A, and the second press-formed portion has an angle of taper B, and the point assembly further has three tapered portions positioned rearwardly from the second press-formed portion, the three tapered portions having angles of taper of C, D and E, respectively, characterized in that the angles of taper A, B, C, D and E, the width S of the inner sealing surface and a width L of the combined width taken along the longitudinal axis of the annular surfaces of the first and second press-formed portions satisfy the following conditions:

$A > B > C, D > C, D > E,$ $140° \geqq A \geqq 55°, E < 60°$, and $L \geqq S \geqq L/10.$

2. The ball-point pen according to claim 1, wherein the point assembly has a spring therein which constantly urges the ball forward along the longitudinal axis with a force smaller than 80g.

3. The ball-point pen according to claim 2, wherein the ink reservoir tube contains an ink having a viscosity ranging from 10 cp to 4000 cp at 25° C, and a greasy follower is positioned rearwardly of the ink and in contact with the ink.

4. The ball-point pen according to claim 1, wherein the ink reservoir tube contains an ink having a viscosity ranging from 10 cp to 4000 cp at 25° C., and a greasy follower is positioned rearwardly of the ink and in contact with the ink.

5. A ball-point pen comprising:

an ink reservoir tube adapted to store an ink; and a point assembly having a front end adapted to be a writing point, a rear end adapted to receive ink from the ink reservoir tube, and a longitudinal axis extending from the rear end to the front end, the point assembly having an inner bore with a rim at the front end and a forward facing ball seat positioned rearwardly from the front end, the inner bore supporting a writing ball between the rim and the ball seat such that the ball is rotatably projected from the front end, the ball has a surface having a curvature, the ball seat has a curvature corresponding to the surface curvature of the ball, and a plurality of channels in the ball seat permit ink flow from the rear end of the point assembly to the front end of the point assembly during writing; wherein:

the point assembly is formed with a first press-formed portion having an outwardly facing annular surface with a first angle of taper, the first press-formed portion positioned at the front end of the point assembly, and a second press-formed portion having an outwardly facing annular surface with a second angle of taper, the second press formed portion positioned rearwardly from the first press-formed portion, the first angle of taper differing from the second angle of taper, the first and second press-formed portions formed such that the rim is inwardly deformed to a dimension smaller than the diameter of the ball to retain the ball in the inner bore, and the first and second press-formed portions formed such that an inwardly directed sealing surface is formed at the rim of the inner bore, the sealing surface having a width S taken along the longitudinal axis, and having a curvature corresponding to the surface curvature of the ball; and wherein:

the ball is movable along the longitudinal axis for a distance F of greater than 3 $\mu$m between a first position in rotatable engagement with the ball seat and a second position in which the width of the sealing surface is in sealing engagement with a corresponding portion of the surface of the ball.

6. The ball-point pen according to claim 5, wherein the point assembly has a spring therein which constantly urges the ball forward along the longitudinal axis with a force smaller than 80g.

7. The ball-point pen according to claim 6, wherein the ink reservoir tube contains an ink having a viscosity ranging from 10 cp to 4000 cp at 25° C, and a greasy follower is positioned rearwardly of the ink and in contact with the ink.

8. The ball-point pen according to claim 5, wherein the ink reservoir tube contains an ink having a viscosity ranging from 10 cp to 4000 cp at 25° C., and a greasy follower is positioned rearwardly of the ink and in contact with the ink.

* * * * *